US006709318B2

(12) United States Patent
Giurgiuman et al.

(10) Patent No.: US 6,709,318 B2
(45) Date of Patent: Mar. 23, 2004

(54) DUAL-GRINDING METHOD FOR BAR BLADES AND GRINDING DISC FOR CARRYING OUT SAID METHOD

(75) Inventors: Horia Giurgiuman, Zürich (CH); Manfred Knaden, Zürich (DE)

(73) Assignee: Oerlikon Geartec AG, Zurich (CH)

( * ) Notice: Subject to any disclaimer, the term of this patent is extended or adjusted under 35 U.S.C. 154(b) by 0 days.

(21) Appl. No.: 10/240,036

(22) PCT Filed: Jan. 22, 2002

(86) PCT No.: PCT/EP02/00600

§ 371 (c)(1),
(2), (4) Date: Sep. 26, 2002

(87) PCT Pub. No.: WO02/058888

PCT Pub. Date: Aug. 1, 2002

(65) Prior Publication Data

US 2003/0054731 A1 Mar. 20, 2003

(30) Foreign Application Priority Data

Jan. 27, 2001 (DE) ..... 101 03 755

(51) Int. Cl.[7] ..... B24B 1/00

(52) U.S. Cl. ..... 451/47; 451/28; 451/48; 451/147; 451/177; 451/185; 451/219; 451/253; 407/56; 407/60; 407/61; 407/62

(58) Field of Search ..... 451/28, 47, 48, 451/147, 177, 185, 219, 253; 407/56, 60, 61, 62

(56) References Cited

U.S. PATENT DOCUMENTS

| | | | | |
|---|---|---|---|---|
| 3,576,061 A | * | 4/1971 | Pahlitzsch | 29/95 |
| 4,012,820 A | * | 3/1977 | Nowak | 29/95 |
| 4,993,505 A | * | 2/1991 | Packer et al. | 175/329 |

FOREIGN PATENT DOCUMENTS

| | | |
|---|---|---|
| DE | 27 33 756 A1 | 2/1979 |
| DE | 199 10 746 A1 | 9/2000 |
| EP | 0 343 983 A2 | 11/1989 |

* cited by examiner

*Primary Examiner*—Joseph J. Hail, III
*Assistant Examiner*—Shantese McDonald
(74) *Attorney, Agent, or Firm*—McCormick, Paulding & Huber LLP

(57) ABSTRACT

A grinding wheel and a method for grinding bar blade for the production of spiral gear teeth are described. For economical grinding of such bar blades the grinding wheel has a conical grinding surface (Pp) widening from a small diameter (d1) to a large diameter (d2), a cylindrical grinding surface (Ps) adjoining the conical grinding surface (Pp), and a toroidal grinding surface (G) adjoining the cylindrical grinding surface (Ps). The grinding wheel embodied in this manner enables profile grinding (rough grinding) and subsequent generating grinding (finish grinding) of the surfaces of the bar blade without the necessity of remounting the blade. For practical purposes the grinding wheel rotates about a stationary axis (S), and the bar blade to be ground is guided along the grinding wheel at appropriately set angles.

22 Claims, 4 Drawing Sheets

DUAL-GRINDING METHOD FOR BAR BLADES AND GRINDING DISC FOR CARRYING OUT SAID METHOD

CROSS-REFERENCE TO RELATED APPLICATIONS

This application is entitled to the benefit of and incorporates by reference essential subject matter disclosed in International Patent Application PCT/EP02/00600 filed on Jan. 22, 2002 and German Patent Application No. 101 03 755.4 filed on Jan. 27, 2001.

FIELD OF THE INVENTION

This invention refers to a grinding wheel and to a method of grinding bar blades, particularly carbide blades for the production of bevel and hypoid gears having arcuate teeth.

BACKGROUND OF THE INVENTION

A known blade for the production of arcuate teeth is designed as a cuboid bar with a shaft having a trapezoidal end. The trapezoidal end comprises a relief flank, a minor flank, a head surface connecting the relief flank with the minor flank, and a rake flank.

A method and a grinding wheel for grinding carbide inserts affixed to the teeth of a grinding tool are known from EP 0 343 983 A2. The design of the grinding wheel is such that its working regions are capable of grinding not only flat surfaces on the carbide inserts, but also adjacent curved surfaces of the tooth.

It is the object of the present invention to provide a grinding wheel and a method for rapid, efficient and precise grinding of bar blades.

SUMMARY OF THE INVENTION

The grinding wheel according to the invention has a conical grinding surface smoothly adjoined by a cylindrical grinding surface smoothly adjoined in turn by a toroidal grinding surface. Therefore, the relief flank, the minor flank and the rake flank can be rough ground by profile grinding with the method according to the invention using the conical grinding surface and its area of transition to the cylindrical grinding surface. The relief flank and the minor flank can be subsequently finish ground by generating grinding at the toroidal grinding surface. In this manner it is possible with one single grinding wheel not only to rough grind all three essential surfaces, namely the relief flank, the minor flank and the rake flank, but also to finish grind the relief flank and the minor flank without resetting the blade. This permits performance of a rapid, complete and precise grinding of the blade.

In one advantageous embodiment of the invention the conical and the cylindrical grinding surfaces have a coarser grain than the toroidal grinding surface. For this reason, the minor flank and the relief flank can be rough ground and the rake flank can be ground, all at high stock removal rates.

In another advantageous embodiment of the invention, the cylindrical grinding surface merges tangentially into the toroidal grinding surface. For this reason it is advantageously possible in one translational movement first of all to rough grind the head surface of the blade with the cylindrical grinding surface, and to finish grind it with the adjacent toroidal grinding surface. This combination of rough grinding and finish grinding of the head surface in one operation reduces the amount of time required for the entire blade grinding process.

In yet another advantageous embodiment of the invention a first radius is formed between the conical grinding surface and the cylindrical grinding surface. The toroidal grinding surface here has a circular arcuate cross section with a second radius. The first radius here is larger than the second radius. During the roughing, i.e. in profile grinding of the blade, the relief flank or the minor flank or the rake flank of the blade is brought into contact with the conical grinding surface in such a manner that a respective shoulder surface is ground at the transition of the relief flank or the rake flank to the blade shaft by the first radius and the transition between the conical and the cylindrical grinding surface, or in addition by a portion of the cylindrical grinding surface. Following the profile grinding, the relief flanks or the rake flank is finished by generating grinding with an overlapping relative translational movement between the blade and the grinding wheel relative to the toroidal grinding surface. Since the radius of the toroidal grinding surface is smaller that the first radius in the transitional area between the conical grinding surface and the cylindrical grinding surface, the respective associated shoulder surface does not have to be ground along with the relief flank or the minor flank during their finishing. This means that the toroidal grinding surface is spared and therefore has a longer working life. Furthermore, the grinding process is abbreviated, since the shoulder surfaces between the relief flank or minor flank and the shaft do not have to be finish ground.

BRIEF DESCRIPTION OF THE DRAWINGS

An embodiment of the invention is explained in greater detail below on the basis of the drawings.

DETAILED DESCRIPTION OF THE PREFERRED EMBODIMENTS

Figure 1:
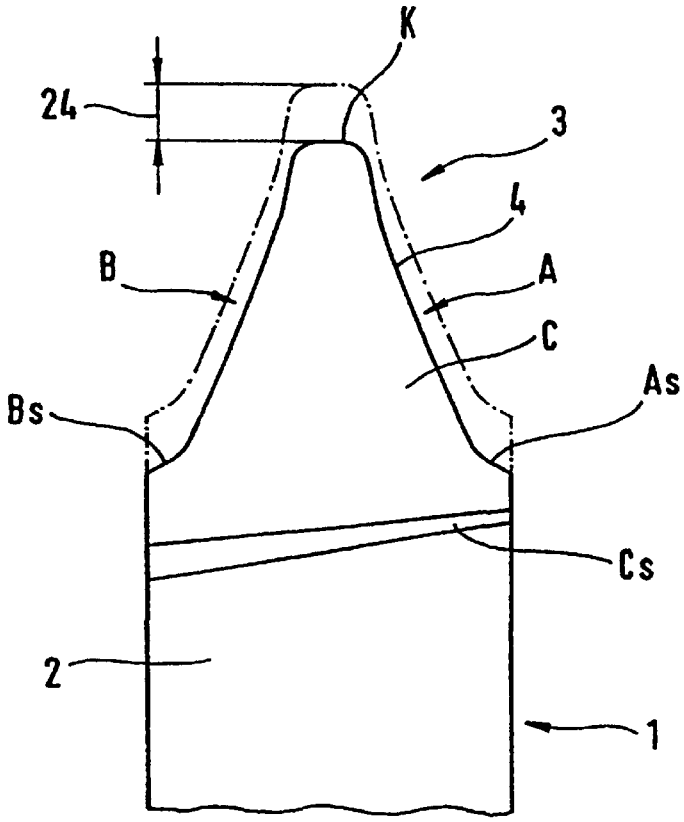
FIG. 1 shows a plan view of a hard-material bar blade.
Figure 2:
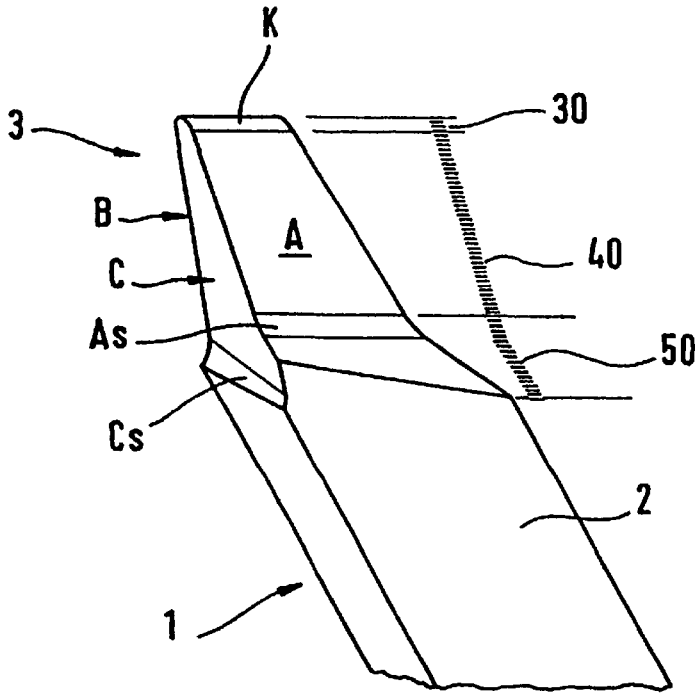
FIG. 2 shows a lateral inclined view of the bar blade.
Figure 3:
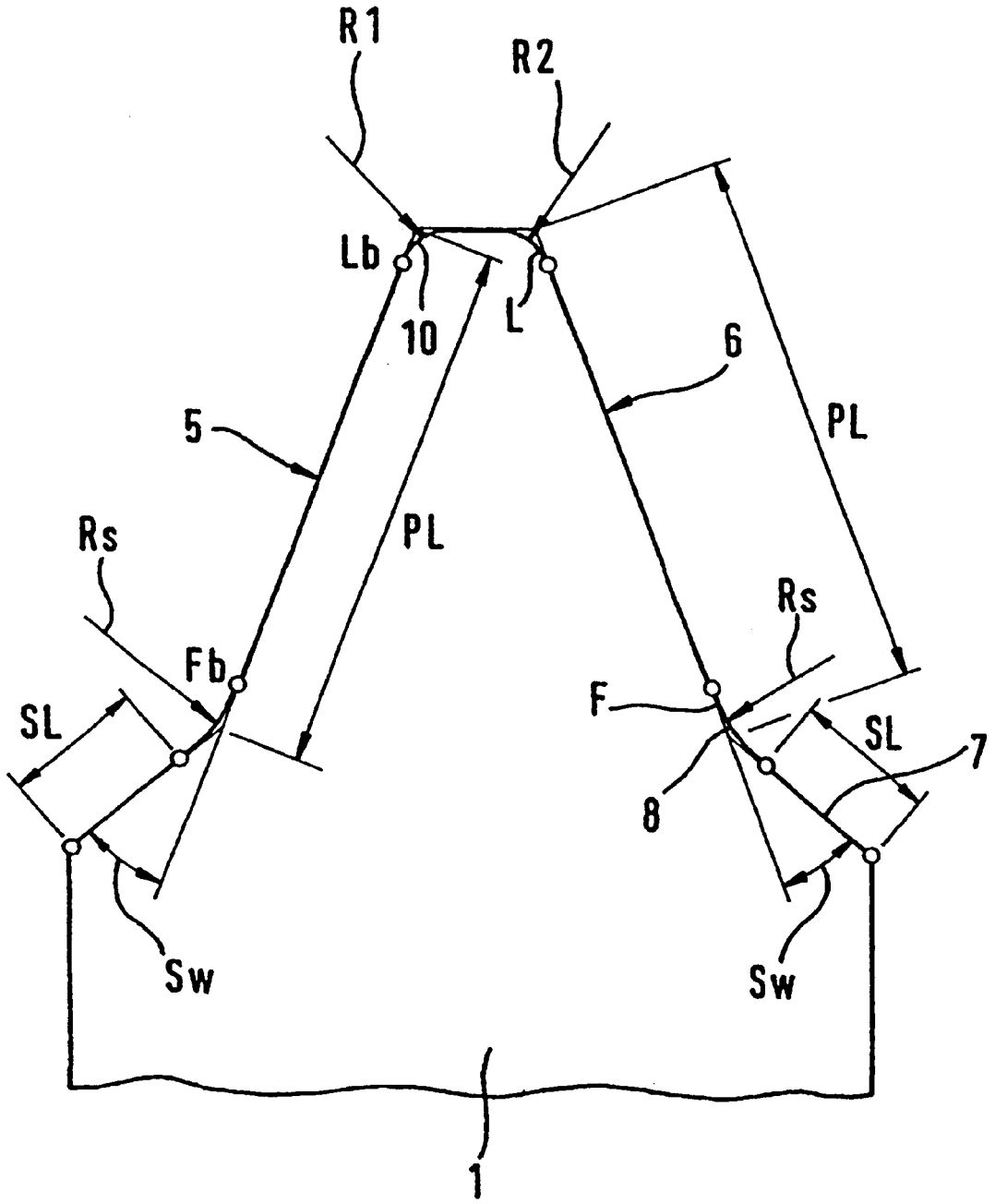
FIG. 3 shows an enlarged plan view of the rake flank of the bar blade.

FIGS. 1 to 3 show an example of a bar blade. There is a great variety of blade types. However, all are similar in shape to the one described below (for example, the flank 40 could be located instead on the left-hand side in FIGS. 1 to 3).

According to FIGS. 1 to 3 a cuboid or bar-shaped blade 1 has a shaft 2 with a rectangular cross section, and a trapezoidal tip 3. A rake flank C is provided on the trapezoidal tip 3; a minor flank B extending back from the rake flank C is provided on the left-hand side in FIG. 1 on a flank 5 of the tip; a relief flank A extending back from the rake flank C is provided on the right-hand side in FIG. 1 on a flank 6 of the tip; and a head surface K extending back from the rake flank C is formed on a top face of the tip. A continuous cutting edge 4 runs along the minor flank B, the head area K, the relief flank A and the rake flank C. As shown here, shoulder areas As or Bs, respectively, can be provided in the area of transition from the relief flank A and the minor flank B to the shaft 2. Also, as shown here, a curved shoulder area Cs can be provided in the area of transition of the rake flank C to the shaft 2. The head, flank, and shoulder are shown on the right in FIG. 2 as 30, 40, and 50, respectively.

The shape of the right-hand and the left-hand flanks of the trapezoidal tip 3 is described below on the basis of FIG. 3. However, due to the largely similar shape of the three flanks, only that of the right-hand flank 6 will be described in detail. The shoulder area As on the right-hand flank 6 has a straight segment 7 and a curved segment 8 with a radius Rs. The straight segment 7 of the shoulder area As merges at a tangent into the curved segment 8, which in turn merges at a tangent into the relief flank A at point F. The relief flank A merges tangentially at point L into a curved segment with radius R2 on the top face of the trapezoidal tip 3. The curved segment in turn merges tangentially into the head surface K, and the head surface K merges tangentially into a curved area 10 with a radius R1, which in turn connects tangentially to the minor flank B. The right flank 6 and the left flank 5 each has a length PL, and the straight segment of the shoulder area As or Bs, respectively, has a length SL. The profile shapes of the flank 6 (length PL) and of the flank 5 depend on the tooth-cutting process. In any event they are not straight.

Figure 4:
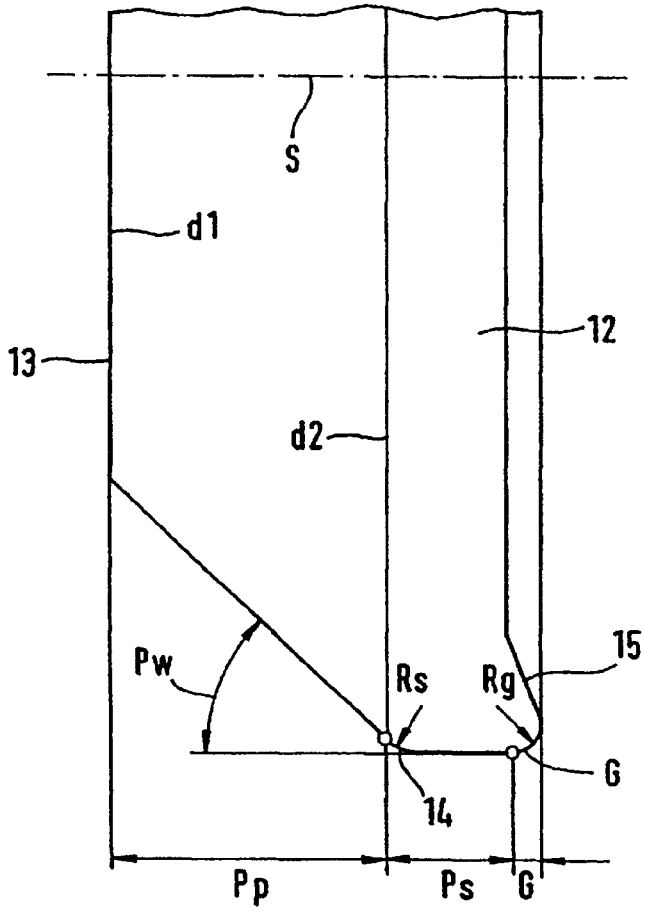
FIG. 4 shows a cut through the grinding wheel.

FIG. 4 shows a grinding wheel 12 with which the blade according to FIGS. 1 to 3 can be ground. The grinding wheel 12 has an axis of rotation S, in relation to which the grinding wheel is mounted in rotational symmetry. The grinding wheel 12 has on one end face a circular clamping surface 13 perpendicular to the axis of rotation S. A conical grinding surface Pp with a small diameter dl and a large diameter d2 extends from the outer periphery of the clamping surface 13. The small diameter d1 here is located at the clamping surface 13. A curved grinding surface 14 with the radius Rs follows tangentially at the side with the large diameter d2 of the conical grinding surface Pp. This grinding surface 14 in turn merges into a cylindrical grinding surface Ps. A toroidal grinding surface G having a circular arcuate cross section with a radius Rg tangentially adjoins the cylindrical grinding surface Ps. The toroidal grinding surface G extends radially inwardly and merges tangentially into a second conical surface 15 undercutting the toroidal grinding surface G.

The grinding wheel 12 can be designed as a one-piece grinding wheel in which the conical grinding surface Pp, the cylindrical grinding surface Ps and also the toroidal grinding surface G can have the same grain size and the same bonding agent.

However, the grinding wheel 12 can also be provided with varying abrasive grain sizes. In this case, the conical grinding surface Pp and the cylindrical grinding surface Ps have a coarser abrasive grain than the toroidal grinding surface G. It is advantageous to apply the different abrasive grain sizes with the same bonding. A small indentation (not shown) can be provided between the toroidal grinding surface G and the cylindrical grinding surface Ps to distinguish the areas with different abrasive grain sizes. Either a galvanic bonding or synthetic resin can be provided as the bonding agent for the abrasive. Either CBN (for HSS) or diamond (for HM) can be used as the abrasive.

In addition, it is possible to design the wheel 12 in two parts, with the toroidal grinding surface G provided on a ring (not shown) that would be mounted by a flange connection to the cylindrical grinding surface Ps. In this case it would be possible to provide the respective region with the abrasive and bonding agent that are best suited to perform the task at hand. It is also possible to replace the two regions at different times independently of one another as a function of the respective wear.

Figure 5:
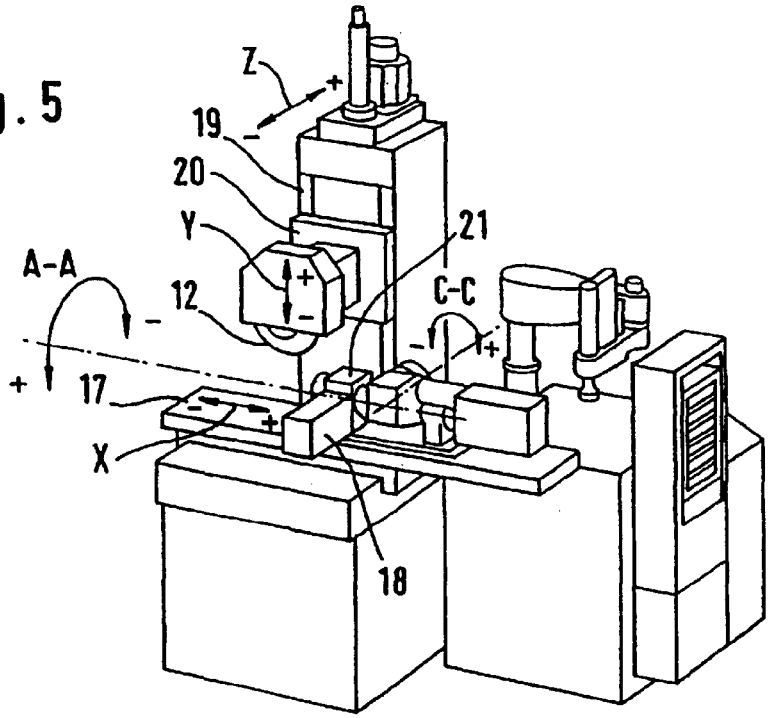
FIG. 5 shows a perspective view of a grinding machine.

FIG. 5 shows a grinding machine which is equipped with the grinding wheel 12 according to FIG. 4 and which can be used to grind the blade 1. The machine has a table 17 on which a slide 18 is capable of reciprocating movement along an x-axis. A column 19 is capable of reciprocating movement along a z-axis at right angles to the x-axis. A second slide 20 can be moved on the column 19 along a y-axis perpendicular to the x-axis and to the z-axis. The x-axis, the y-axis, and the z-axis form a rectangular coordinate system. The grinding wheel 12 is mounted so as to rotate on the second slide 20. A clamping device 21 for holding the blade 1 is mounted on the slide 18. The clamping device is bearing mounted relative to the slide 18 by a swivel axis C—C and an axis of rotation A—A perpendicular to the swivel axis C—C. The x-axis, the y-axis, the z-axis, the A—A-axis, and the C—C-axis can be used not only for positioning, but also to traverse CNC-controlled paths.

A chronological description of the operation of grinding the blade I with the grinding wheel 12 is given below.

Grinding the rake flank C

The rake flank C is oriented parallel to the conical grinding surface Pp such that the shoulder surface Cs of the rake flank C is positioned at the curved grinding surface 14 with the radius Rs. The rake flank C and the associated shoulder surface Cs are ground using reciprocating grinding with relatively successive feed of the blade 1 in relation to the grinding wheel 12.

Grinding the minor flank B

The left-hand flank 5 is oriented with the minor flank B parallel to the conical grinding surface Pp, with the shoulder surface Bs being positioned at the curved grinding surface 14 with the radius Rs. The minor flank B is then ground together with the associated shoulder surface Bs by reciprocating grinding with successive feed until the desired amount has been removed.

Grinding the relief flank A

The relief flank A is oriented parallel to the conical grinding surface Pp, with the shoulder surface As being positioned at the curved grinding surface 14 with the radius Rs. The relief flank A is ground together with the associated shoulder surface As by reciprocating grinding with successive feed until the desired amount has been removed.

Figure 6C:
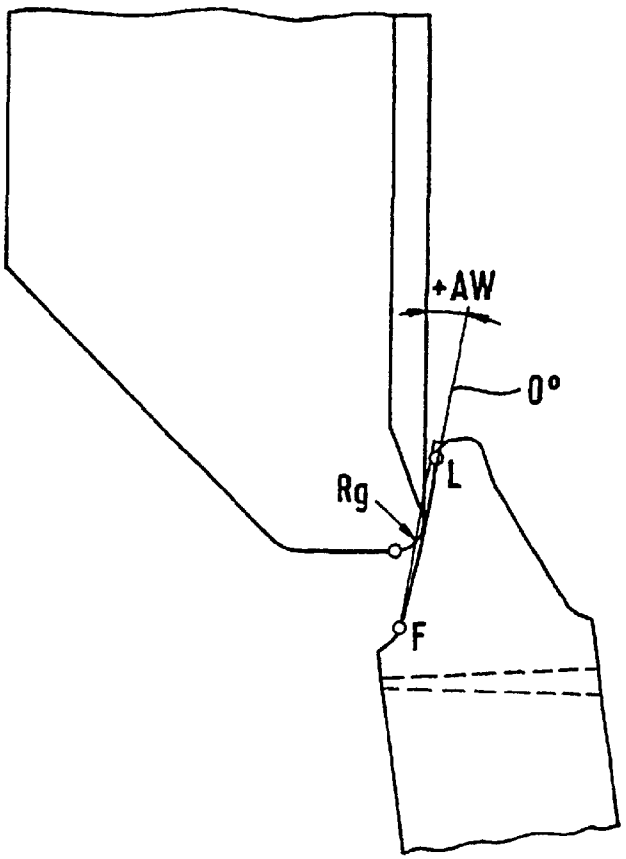
FIGS. 6*a, b, c* show the process of grinding a bar blade using the grinding wheel according to FIG. 4.
Figure 6B:
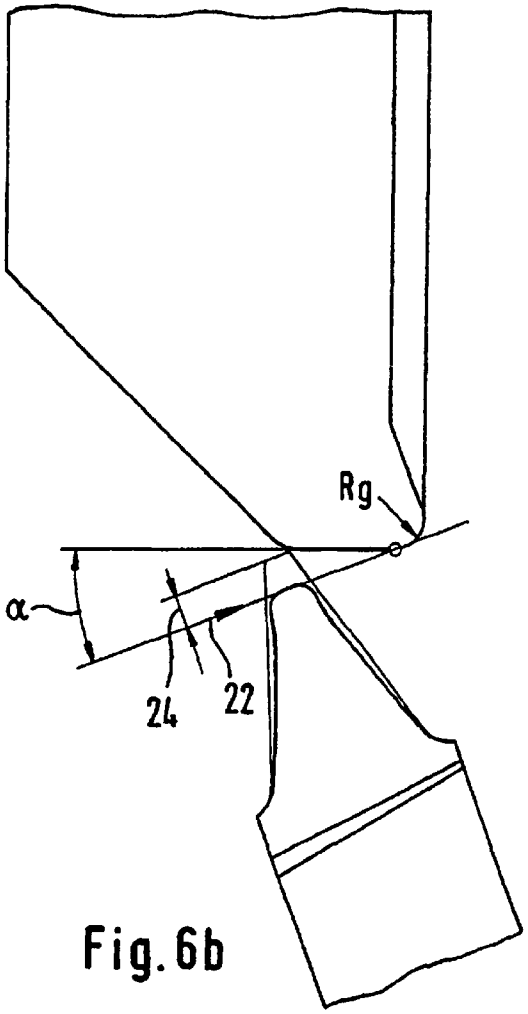
Figure 6A:
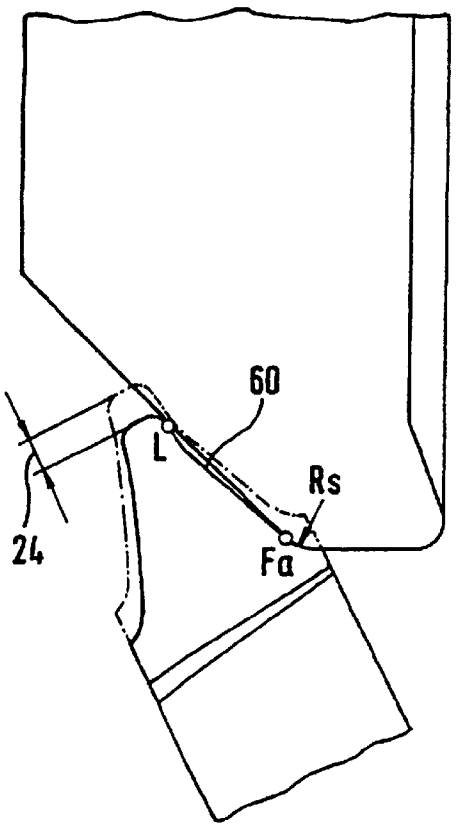

Subsequent to the grinding of the relief flanks A and B, the blade has been transformed from the shape represented by a dot-dash line in FIG. 6*a* to that shown as a thin line in FIG. 6*b*. A large overmeasure 24 has been left over here, especially at the head end of the blade 1. An additional comma or sickle-shaped overmeasure 60—depending on the profile shape—is also left on the relief flanks A and B.

Grinding the head surface K

After the grinding of the relief flank A the blade 1 is retracted substantially longitudinally of its shaft relative to the conical grinding surface Pp. It is oriented at an angle_in relation to the cylindrical grinding surface Ps and the toroidal grinding surface G such that first of all the overmeasure 24 on the head 30 of the blade 1 is removed by the cylindrical grinding surface Ps with a movement in the direction of an arrow 22, then, toward the end of the movement along the arrow, 22 it is moved past the toroidal grinding surface G, and a head surface K is produced.

Finish grinding the minor flank B

Following the grinding of the head surface K as described above, the blade 1 is guided by an overlapping movement along the toroidal grinding surface G, so that both the radius R1 and the remaining comma-shaped overmeasure are ground. Since the radius Rg of the toroidal grinding surface G is smaller than the radius Rs of the curved grinding surface 14, the process of finishing the minor flank B is completed upon reaching the point Fb, so that the shoulder surface Bs is no longer ground by the toroidal grinding surface G Finishing the relief flank A The blade 1 is reoriented such that the relief flank A at point Fa is positioned at a point on the periphery of the toroidal grinding surface G. Through an overlapping movement of the blade 1 and of the grinding wheel 12, the comma-shaped overmeasure on the relief flank A is ground down to the final form of the blade 1. With the blade 1 oriented in the same direction, the radius R2 and the head surface K are finish ground in a continued overlapping movement. As was the case in the finishing of the minor flank B, the shoulder surface As of the relief flank A is not also ground when the relief flank A is ground by the toroidal grinding surface G. The transition from reciprocating grinding to generating grinding takes place precisely at base point F, so that the shoulder is not finish ground unnecessarily.

In the process of grinding the blade 1 using the grinding wheel 12 described above, it is not always necessary to grind the rake flank C as well. Instead, the rake flank C is only ground as needed.

According to FIG. 3 a shoulder angle Sw is formed between the right-hand flank 6 and the shoulder surface As, and also between the left-hand flank 5 and the shoulder surface Bs. Furthermore, according to FIG. 4 a swing angle Pw is formed at the grinding wheel 12 between the conical grinding surface Pp and the cylindrical grinding surface Ps. In the rough grinding of the relief flank A and the associated shoulder surface As, and of the minor flank B and the associated shoulder surface Bs, the respective shoulder angle Sw is determined by the swing angle Pw and the spatial orientation between the blade 1 and the grinding wheel 12. An interrelationship $R_s > R_g$ exists between the shoulder radius Rs and the generating radius Rg. The shoulder angle or the swing angle has both a geometric and a technological definition.

FIG. 6*c* shows the selection of a setting angle AW, which can be selected on either side of a position with a setting angle AW of zero degrees. The overmeasure for the subsequent finishing is optimized by way of the setting angle AW, which can differ from the shoulder angle (30° or 45°). The comma-shaped overmeasure resulting from this is optimally designed in this way. When a certain number of blades has been ground at a certain setting angle AW, a change to another setting angle is made before a significant amount of wear occurs. Each setting angle will result in a removal area or a flattened area in the working region of the grinding wheel 12. The next setting angle AW is selected such that the next flattened area adjoins the preceding flattened area. The result of this is that at the end, the cross section of the working region is delimited by a polygon. The sides of the polygon here are formed by the flattened areas. The maximum width of the permissible flattened areas, for example, lies within a magnitude of 1 $\mu$m.

To be able to determine the point at which a significant amount of wear has occurred, the removal areas or flattened areas of the grinding wheel working regions produced by the grinding are continuously measured and compared with a value of the maximum permissible removals or flattened areas that corresponds to a significant amount of wear in the working region G of the grinding wheel 12. A change to another setting angle is made in time before the point at which a significant amount of wear occurs. This process permits optimal exploitation of the toroidal grinding surface G, thereby maximizing the tool life.

What is claimed is:

1. A grinding wheel for grinding bar-shaped blades for the production of bevel and hypoid gears having arcuate teeth, having an axis of rotation (S), a conical grinding surface (Pp) widening from a small diameter (d1) to a large diameter (d2), a cylindrical grinding surface (Ps) smoothly adjoining a side of the conical grinding surface (Pp) with the large diameter (d2), a toroidal grinding surface (G) adjoining the cylindrical grinding surface (Ps).

2. The grinding wheel according to claim 1, wherein the conical grinding surface (Pp), the cylindrical grinding surface (Ps), and the toroidal grinding surface (G) have the same grain size.

3. The grinding wheel according to claim 1, wherein the conical grinding surface (Pp) and the cylindrical grinding surface (Ps) have the same grain size and that the toroidal grinding surface (G) has a finer grain than the conical and the cylindrical grinding surfaces (Pp, Ps).

4. The grinding wheel according to claim 1, wherein the cylindrical grinding surface (Ps) tangentially merges with the toroidal grinding surface (G).

5. The grinding wheel according to claim 1, wherein a first radius (Rs) is provided in the transitional region between the conical grinding surface (Pp) and the cylindrical grinding surface (Ps), and that the toroidal grinding surface has a circular arcuate cross section with a second radius (Rg), said first radius (Rs) being larger than said second radius (Rg).

6. The grinding wheel according to claim 1, wherein the toroidal grinding surface (G) merges inwardly in the direction of the axis of rotation(s) into a second conical grinding surface designed as an undercut of the toroidal grinding surface (G).

7. The grinding wheel according to claim 1, further comprising a clamping surface disposed at right angles to the axis of rotation (S), with small diameter (d1) of the conical grinding surface (Pp) adjoining the clamping surface.

8. A method of grinding bar-shaped blades for the production of arcuate teeth using a grinding wheel, with the blade being provided as a cuboid bar with a shaft and a trapezoidal tip, and with the trapezoidal tip having a relief flank (A), a minor flank (B), a head surface (K) provided between the two relief flanks (A, B), and a rake flank (C) common to the relief flanks (A, B) and the head surface (K), so that a cutting edge is formed between the relief flanks (A, B), the head surface (K) and the rake flank C, the method including the steps of:

a) profile grinding at least one of the relief flank (A) the minor flank (B) and the rake flank (C) with a conical grinding surface (Pp), with a shoulder surface (As, Bs, Cs) being formed on the blade at the transition to the shaft by a transitional region between the conical grinding surface (Pp) and a cylindrical grinding surface (Ps);

b) generating grinding at least one of the relief flank (A) the minor flank (B) and the head surface (K) by overlapping two translational movements along a toroidal grinding surface (G).

9. The method according to claim 8, including the further step of:

c) grinding the head surface (K) of the blade by moving the head surface (K) towards the cylindrical grinding surface (Ps) and past the toroidal grinding surface (G)

by means of a relative translational movement at an angle of inclination ($\alpha$) of the head surface (K) to a surface line of the cylindrical grinding surface (Ps), causing the head surface (K) to be rough ground by the cylindrical grinding surface (Ps) and subsequently finish ground by the toroidal grinding surface (G).

10. The method according to claim 9, wherein in step c) an overmeasure on the head surface (K) is ground off.

11. The method according to claim 10, including the further step of:

e) finish grinding the relief flank (A), a radius (R2) formed between the head surface (K) and the relief surface (A), and the head surface (K) subsequently to step d) by overlapping two relative translational movements along the toroidal grinding surface (G).

12. The method according to claim 11, wherein in step e) the grinding is started adjacent to the shoulder surface (As) at the transition (Fa) from the relief flank (A) to the shoulder surface (As).

13. The method according to claim 9, including the further step of:

d) finish grinding the minor flank (B) and a radius (R1) formed between the head surface (K) and the minor flank surface (B) subsequently to step c) by overlapping two translational movements along the toroidal grinding surface (G).

14. The method according to claim 8, wherein in step a) at least one of the shoulder surface (As) between the relief flank (A) and the shaft, the shoulder surface (Bs) between the minor flank (B), and the shaft and the shoulder surface (Cs) between the rake flank (C) and the shaft is finish ground.

15. The method according to claim 8, wherein in at least one of steps b), c), d) and e) a facet is formed between at least one of the cutting edge and the relief flank (A), and the minor flank (B) and the head surface (K), the facet having a smaller relief angle than at least one of the relief flank (A), the minor flank (B) and the head surface (K).

16. The method according to claim 8, wherein the grinding in step a) is performed by one of reciprocating or plunge grinding.

17. A grinding wheel for grinding bar-shaped blades for the production of bevel and hypoid gears having arcuate teeth, having an axis of rotation (S), a conical grinding surface (Pp) widening from a small diameter (d1) to a large diameter (d2), a cylindrical grinding surface (Ps) smoothly adjoining a side of the conical grinding surface (Pp) with the large diameter (d2), a toroidal grinding surface (G) adjoining the cylindrical grinding surface (Ps), wherein the conical grinding surface (Pp) and the cylindrical grinding surface (Ps) have the same grain size and wherein the toroidal grinding surface (G) has a finer grain than the conical grinding surface (Pp) and the cylindrical grinding surface (Ps).

18. The grinding wheel according to claim 17, wherein the conical grinding surface (Pp), the cylindrical grinding surface (Ps), and the toroidal grinding surface (G) have the same grain size.

19. The grinding wheel according to claim 17, wherein the cylindrical grinding surface (Ps) tangentially merges with the toroidal grinding surface (G).

20. The grinding wheel according to claim 17, wherein a first radius (Rs) is provided in the transitional region between the conical grinding surface (Pp) and the cylindrical grinding surface (Ps), and that the toroidal grinding surface has a circular arcuate cross section with a second radius (Rg), said first radius (Rs) being larger than said second radius (Rg).

21. The grinding wheel according to claim 17, wherein the toroidal grinding surface (G) merges inwardly in the direction of the axis of rotation(s) into a second conical grinding surface designed as an undercut of the toroidal grinding surface (G).

22. The grinding wheel according to claim 17, further comprising a clamping surface disposed at right angles to the axis of rotation (S), with small diameter (d1) of the conical grinding surface (Pp) adjoining the clamping surface.

* * * * *

UNITED STATES PATENT AND TRADEMARK OFFICE

CERTIFICATE OF CORRECTION

PATENT NO. : 6,709,318 B2
DATED : March 23, 2004
INVENTOR(S) : Horia Giurgiuman et al.

It is certified that error appears in the above-identified patent and that said Letters Patent is hereby corrected as shown below:

Title page,
Item [75], Inventors, "Manfred Knaden", please replace the country code "(DE)" with -- (CH) --.

Signed and Sealed this

Twenty-second Day of June, 2004

JON W. DUDAS
*Acting Director of the United States Patent and Trademark Office*